US005188521A

United States Patent [19]

Kawahara et al.

[11] Patent Number: 5,188,521

[45] Date of Patent: Feb. 23, 1993

[54] SCROLL COMPRESSOR WITH REDUCED VIBRATION RESULTING FROM THE OLDHAM'S RING

[75] Inventors: Sadao Kawahara, Otsu; Michio Yamamura, Kusatsu; Jiro Yuda, Ikoma; Yoshinori Kojima, Kusatsu; Shuichi Yamamoto, Otsu; Manabu Sakai, Toyonaka; Shigeru Muramatsu; Osamu Aiba, both of Kusatsu, all of Japan

[73] Assignee: Matsushita Electric Industrial Co., Ltd., Osaka, Japan

[21] Appl. No.: 688,580

[22] PCT Filed: Nov. 2, 1990

[86] PCT No.: PCT/JP90/01422

§ 371 Date: Sep. 3, 1991

§ 102(e) Date: Sep. 3, 1991

[87] PCT Pub. No.: WO91/06774

PCT Pub. Date: May 16, 1991

[30] Foreign Application Priority Data

Nov. 2, 1989 [JP] Japan ..... 1-287020

[51] Int. Cl.[5] ..... F04C 18/04; F04C 29/00

[52] U.S. Cl. ..... 418/55.3; 418/151

[58] Field of Search ..... 418/55.3, 151

[56] References Cited

FOREIGN PATENT DOCUMENTS

| | | | |
|---|---|---|---|
| 61-187588 | 8/1986 | Japan . | |
| 61-261693 | 11/1986 | Japan . | |
| 62-3185 | 1/1987 | Japan . | |
| 63-32185 | 2/1988 | Japan | 418/55.3 |
| 1-88085 | 6/1989 | Japan . | |
| 1-227885 | 9/1989 | Japan | 418/55.3 |

*Primary Examiner*—John J. Vrablik

*Attorney, Agent, or Firm*—Stevens, Davis, Miller & Mosher

[57] ABSTRACT

A balance weight to equilibrate an inertial force due to reciprocation of an Oldham's ring is mounted so that a vibration due to an unbalanced inertial force of the Oldham's ring is transmitted in a direction perpendicular to or almost perpendicular to a connecting direction between the closed vessel and the accumulator, whereby a vibration resulting from an unbalanced inertial force of the compressor body due to the balance weight to equilibrate the inertial force on account of the reciprocation of the Oldham's ring is increased in a direction perpendicular to or almost perpendicular to the connecting direction between the closed vessel and the accumulator. The vibration, however, is reduced in the connecting direction or in a direction close to the connecting direction. As a result, vibrations of pipes connecting the closed vessel to the accumulator are reduced, and reduction of noise of the overall air conditioning system is attained.

1 Claim, 2 Drawing Sheets

SCROLL COMPRESSOR WITH REDUCED VIBRATION RESULTING FROM THE OLDHAM'S RING

DESCRIPTION

1. Technical Field

The present invention relates to a scroll compressor, particularly, to a balance weight thereof.

2. Background Art

Generally, in a scroll compressor, as shown in FIG. 1, a compression mechanism 7 which is formed by a fixed scroll 10 and an orbital scroll 11 is arranged in a closed vessel 1, mounted via a fixing bracket 3 to a support structure (not shown), and an eccentric portion 9 of a crank shaft 8 rotatingly driven by a motor 6 which comprises a stator 4 and a rotor 5 is connected to the compression mechanism 7 to transmit a rotating force to thereby effect compression operation. The fixed scroll 10 and the orbital scroll 11 are meshed with each other and a plurality of compression spaces 13 are formed therebetween. An Oldham's ring 12 is arranged between the orbital scroll 11 and a bearing member 14 in order to prevent the orbital scroll 11 from rotating. The Oldham's ring 12 is adapted to repeat reciprocation when the orbital scroll 11 orbits eccentrically.

However, the bearing member, 14 is vibrated by unbalanced inertial force which results from the reciprocation of the Oldham's ring 12. The vibration of the bearing member 14 is transmitted to the closed vessel 1, so that the vibration becomes large. Moreover, when the compressor is mounted on, for example, an air conditioner, the vibration is transmitted to an accumulator through pipings and the piping system is vibrated. As a result, the noise generated by the air conditioner as a whole is increased. Such vibration is one the primary causes of noise generated by the air conditioner. In a prior art system to cope with such subject matter, for example, a connecting pipe to the accumulator 2 which is connected to the inlet side of the compressor is made to have elasticity by an extension pipe 20 as shown in FIG. 2, whereby it is intended to reduce the vibration and the noise of overall air conditioner. In FIG. 2, elements 16 and 17 are heat exchangers, and elements 18 and 19 are an expansion value and a four-way valve respectively. Further, in another prior art system, as can be seen in Japanese Patent Unexamined Publication No. 62-3185, a fixing direction between the bearing member and the closed vessel is not identical with a direction of the movement of the Oldham's ring so that the vibration of the bearing member is not directly transmitted to the closed vessel, whereby it is intended to reduce the noise.

DISCLOSURE OF INVENTION

An object of the present invention is to reduce the noise of the overall air conditioner merely by changing a direction of the vibration of a compressor body by means of a method of mounting the balance weight without necessitating structure to reduce the vibration of the compressor body such as that of the above discussed prior art systems.

Concretely, a position or a mass of a balance weight to equilibrate the inertial force due to the reciprocation of the Oldham's ring is mounted so that the vibration due to the unbalanced inertial force of the Oldham's ring is transmitted in a direction perpendicular to or almost perpendicular to a connecting direction between the closed vessel and the accumulator.

BEST MODE FOR CARRYING OUT THE INVENTION

Figure 1:
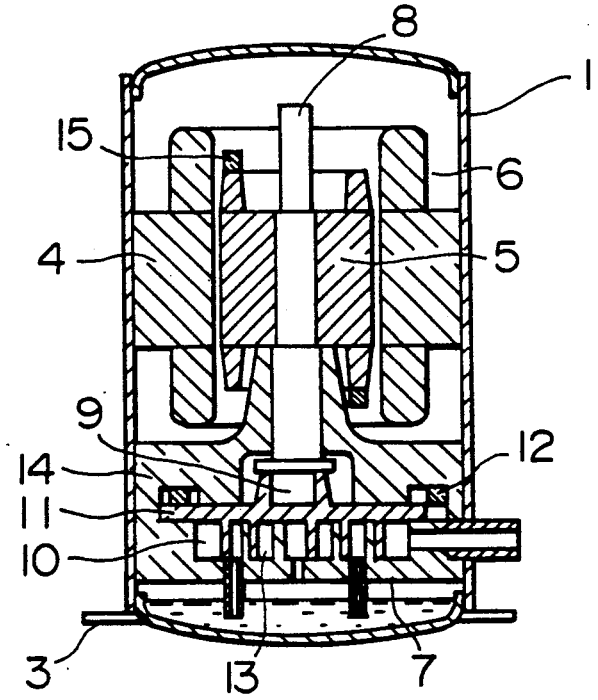
FIG. 1 PRIOR ART
FIG. 1 is a vertical cross section of a prior art scroll compressor.
Figure 2:
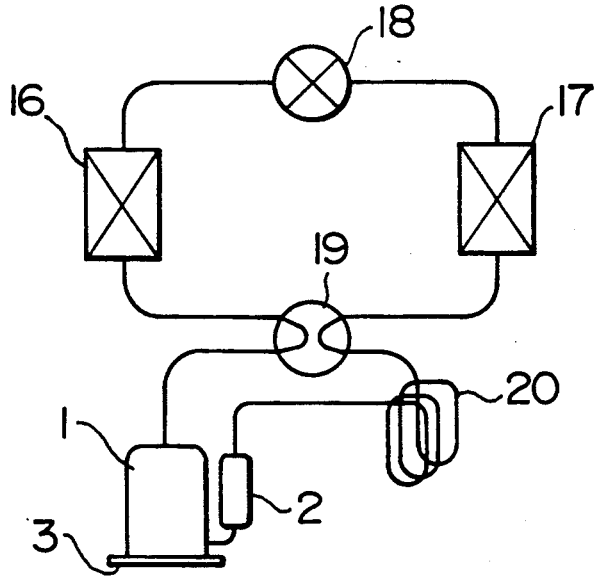
FIG. 2 PRIOR ART
FIG. 2 is a structural diagram showing one example of the prior art to reduce noise due to vibration of a compressor body when the compressor is mounted in an air conditioner.
Figure 3:
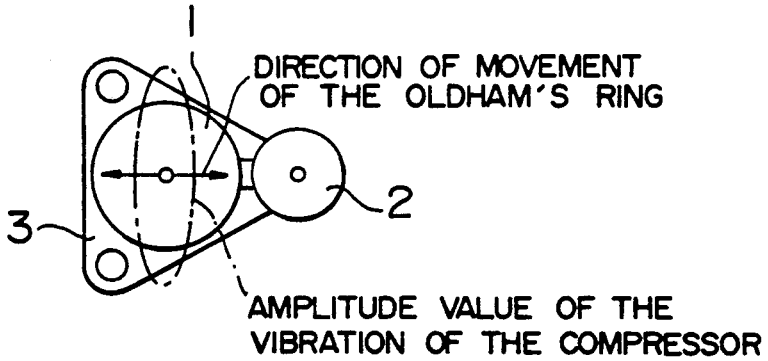
FIG. 3 is an explanation diagram showing a direction of vibration of a compressor according to the present invention when viewed from above the compressor.

An embodiment of the invention will be described hereinafter with reference to the drawings. In FIG. 3, the vibration direction when viewed from above a compressor according to one embodiment of the invention is shown by a one-dotted chain line. An Oldham's ring 12 to restrain rotation of an orbital scroll 11 reciprocates in a direction toward an accumulator 2 or in a direction close thereto. At this time, an unbalanced inertial force due to that reciprocation acts, so that a bearing member 14 is vibrated. The vibration is transmitted to the closed vessel 1 and the closed vessel 1 is vibrated in the same direction as the reciprocation of the Oldham's ring 12. Meanwhile, it is possible to vary the vibration direction at will by mounting a balance weight 15 on, e.g., rotor 5 of motor 6 such that the center of mass of balance of weight 15 is located at a radius from the center of rotation of the crank shaft to generate an unbalanced inertial force to negate the unbalanced inertial force of the Oldham'ring. That is to say, it is possible to cause a vibration direction of a compressor body to be perpendicular to or almost perpendicular to the direction toward the accumulator 2. In FIG. 3, the direction of the movement of the Oldham's ring is in the direction toward the accumulator 2 or in a direction close thereto, but because it is possible to vary the vibration direction of the compressor body (vessel 1) by means of the method of mounting the balance weight 15 as described above, the direction of the movement is not particularly limited to the above-described direction. Next, an operation of the embodiment of the invention will be described. By making the vibration direction of the compressor body perpendicular to or almost perpendicular to a connecting direction between the closed vessel 1 and the accumulator 2, vibration in that direction is increased but the vibration transmitted to the accumulator 2 is reduced, whereby also the vibration of connecting pipings of the accumulator 2 is reduced and when the compressor is mounted in the air conditioner, it is possible to reduce the noise of the overall air conditioner in operation.

INDUSTRIAL APPLICABILITY

As described above, in the invention, it is possible to reduce the vibration transmitted to the accumulator, to make the vibration of the connecting pipings connected with the accumulator small and to reduce the noise of the whole of the air conditioner only by mounting the balance weight so that the angle of the vibration of the compressor body is perpendicular to or almost perpendicular to the connecting direction between the closed vessel and the accumulator. Further, it is not needed to provide any extension pipes like the prior art and it is possible to reduce suction loss.

We claim:

1. A scroll compressor, comprising:

a closed vessel;

a motor disposed in said vessel;

a compression mechanism disposed in said vessel and driven by said motor, said compression mechanism including a fixed scroll, an orbital scroll arranged to mesh with said fixed scroll so as to form a plurality of compression spaces, an Oldham's ring reciprocating and preventing rotation of said orbital scroll, and a crank shaft transmitting a rotational driving force from said motor to said orbital scroll;

an accumulator disposed outside of said closed vessel and connected to said closed vessel through a piping means; and a balance weight means, driven to rotate by said motor, at a radius from the center of rotation of said crank shaft for causing a resultant force of an unbalanced inertial force of said Oldham's ring and an unbalanced inertial force of said balance weight means driven by said motor to be transmitted to said vessel, in a direction perpendicular to or almost perpendicular to a connecting direction of said vessel and said accumulator via said piping means.

* * * * *